US007083310B2

(12) United States Patent
Bauer

(10) Patent No.: US 7,083,310 B2
(45) Date of Patent: Aug. 1, 2006

(54) LAMP HARP MOUNT

(76) Inventor: Ronald Bauer, 12075 Summit Cir., Beverly Hills, CA (US) 90210

( * ) Notice: Subject to any disclaimer, the term of this patent is extended or adjusted under 35 U.S.C. 154(b) by 180 days.

(21) Appl. No.: 10/857,560

(22) Filed: May 28, 2004

(65) Prior Publication Data

US 2005/0276055 A1 Dec. 15, 2005

(51) Int. Cl.
*F21V 17/18* (2006.01)

(52) U.S. Cl. ..... 362/452; 362/417

(58) Field of Classification Search ..... 362/417, 362/382, 433, 449, 388, 351, 452, 319, 322
See application file for complete search history.

(56) References Cited

U.S. PATENT DOCUMENTS

| | | | | | |
|---|---|---|---|---|---|
| 1,482,957 | A | * | 2/1924 | Tizley | 362/452 |
| 1,946,959 | A | | 2/1934 | Auerbach | |
| 1,994,410 | A | | 3/1935 | Texier | |
| 2,164,901 | A | * | 7/1939 | Chilo | 362/452 |
| 2,209,151 | A | * | 7/1940 | Chilo | 362/452 |
| 2,264,145 | A | * | 11/1941 | Chilo | 362/417 |
| 2,408,522 | A | | 10/1946 | Leef | |
| 2,435,954 | A | | 2/1948 | Berger | |
| 2,481,355 | A | | 9/1949 | Schwartz et al. | |
| 2,650,294 | A | | 8/1953 | Berger | |
| 2,654,006 | A | | 9/1953 | Schafer | |
| 2,662,166 | A | | 12/1953 | Berger | |
| 2,665,374 | A | * | 1/1954 | Berger | 362/452 |
| 2,670,432 | A | | 2/1954 | Benander | |
| 2,802,098 | A | | 8/1957 | Chilo | |
| 2,805,329 | A | * | 9/1957 | Golden | 362/452 |
| 2,805,330 | A | * | 9/1957 | Golden | 362/452 |
| 2,808,503 | A | * | 10/1957 | Ball | 362/452 |
| 2,895,041 | A | | 7/1959 | Shoglow | |
| 3,016,455 | A | | 1/1962 | Goldfine | |
| 3,281,590 | A | | 10/1966 | Truax et al. | |
| 3,309,515 | A | | 3/1967 | Fanshier | |
| 3,527,934 | A | | 9/1970 | Berger | |
| 4,414,618 | A | | 11/1983 | Jacobson | |
| 6,286,981 | B1 | * | 9/2001 | McEllen et al. | 362/417 |

* cited by examiner

*Primary Examiner*—Ali Alavi
*Assistant Examiner*—Bao Q. Truong
(74) *Attorney, Agent, or Firm*—Bruce A. Jagger

(57) ABSTRACT

A safe lamp harp that inexpensively and effectively limits the rotation of a shade relative to the lamp harp is disclosed. The lamp harp include a frame member with normally downwardly depending legs and a generally straight axle portion at the top of the harp between the legs. A shade mounting assembly is rotatably mounted to the axle portion for rotation through an arc of no more than approximately 45 degrees. The shade mounting assembly includes a generally U-shaped yoke with a headed stud projecting normally upwardly from the base of the U-shaped yoke. The headed stud includes an enlarged head element normally disposed on the downwardly facing side of the base of the U-shaped yoke.

13 Claims, 2 Drawing Sheets

LAMP HARP MOUNT

BACKGROUND OF THE INVENTION

1. Field of the Invention

The invention relates in general to lamp harps and, more particularly, embodiments of the present invention relate to lamp harps wherein an inverted U-shaped bracket-headed machine screw assembly is mounted to the top of the harp frame for rotation through a limited arc so as to prevent a lamp shade from contacting a bulb mounted in an associated lamp socket.

2. Description of the Prior Art

Lamp harps have been well known for many years. Many lamp harps provide for the mounting of a lamp shade that is mounted through an assembly to the harp frame at the top of the harp. See, for example, Auerbach U.S. Pat. No. 1,946,959 (an upwardly extending threaded stud is fixed to the top of the harp so the angle of the shade is not adjustable); Berger U.S. Pat. No. 2,435,954 (an inverted U-shaped bracket-threaded stud assembly is rotatably mounted to a straight portion of the harp frame at the top of the frame so that the lamp shade can be tilted through whatever arc can be traversed until the shade encounters an obstacle—such as a light bulb—that prevents further rotation); and Schwartz et al. U.S. Pat. No. 2,481,355 (similar to Berger U.S. Pat. No. 2,435,954 showing an inverted U-shaped bracket-headed machine screw assembly). The uncontrolled rotation of the shade mounting assemblies of, for example, Berger and Schwartz et al. presents a fire safety hazard. When a combustible shade comes into contact with or close proximity to a hot bulb there is a risk of fire. Various elaborate rotational mechanisms had been previously proposed without addressing the fire safety issue. See, for example, Fanshier U.S. Pat. No. 3,309,515 (an elaborate and expensive machined clamp that is activated by a threaded lock purports to clamp the shade in a particular position); Truax et al. U.S. Pat. No. 3,281,590 (the shade is mounted through an elaborate and expensive ball-socket assembly); and Benander U.S. Pat. No. 2,670,432 (a multi-part shade mounting that apparently permits rotation around two perpendicular axes). Various complicated and expensive expedients had been previously proposed for limiting the rotation of a shade. See, for example, Jacobson U.S. Pat. No. 4,414,618 (an elaborate and expensive leveling plate mounted on top of a conventional inverted U-shaped bracket-threaded stud assembly); and Goldfine U.S. Pat. No. 3,016,455 (an elaborate and expensive lockable frusto-spherical bearing mounted on top of a conventional inverted U-shaped bracket-threaded stud assembly). Many other proposed expedients had been offered. Chilo U.S. Pat. No. 2,264,145, for example, discloses an expedient wherein the bulb is mounted in a downwardly depending configuration and the shade pivots with the bulb. The prior art devices and methods are not without their shortcomings. A major shortcoming of typical prior art devices and methods is that they are either too complicated and expensive to make or they present a fire hazard. Those concerned with these problems recognize the need for improvements.

These and other difficulties of the prior art have been overcome according to the present invention.

BRIEF SUMMARY OF THE INVENTION

The present invention has been developed in response to the current state of the art, and in particular, in response to these and other problems and needs that have not been fully or completely solved by currently available lamp harp shade mounting assemblies. Thus, it is an overall object of the present invention is to effectively resolve at least the problems and shortcomings identified herein. In particular, it is an object of the present invention to provide a shade mounting assembly that is simple, inexpensive and very effective in limiting the arc through which a lamp shade may be rotated. It is also an object of the present invention to provide such an assembly that limits the arc through which a shade may be tilted so as to prevent the shade from contacting the light bulb and starting a fire.

To acquaint persons skilled in the pertinent arts most closely related to the present invention, a preferred embodiment of a lamp harp that illustrates a best mode now contemplated for putting the invention into practice is described herein by, and with reference to, the annexed drawings that form a part of the specification. The exemplary assembly is described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification or drawings.

A preferred embodiment includes a harp frame member, preferably, but not necessarily with a generally straight axle portion at the top. The axle portion includes integral stop elements. A shade mounting assembly is rotatably mounted to the axle portion, but the nominal extent of the arc is limited to from approximately 2 to 45, preferably approximately 2 to 30 degrees. More preferably, the nominal total angular excursion of the shade is generally limited to between approximately 2 to 10 or even 2 to 6 degrees. The usual purpose of the limited arcuate adjustment is to allow a decorator to accommodate for uneven floors and furniture. For most purpose, a limited arc of approximately 10 degrees will provide all of the adjustment necessary. Some designs, however, dictate the availability of larger arcs. Arcs in excess of approximately 45 degrees present too great a risk of creating a fire hazard. These lamp harps are generally manufactured with metal stamping operations so they are not as precise as if machining operations such as, for example, milling, were employed in their production. Although, for example, the nominal total extent of the arc as called for in a design may be 5 degrees, the actual extent of the total arcs exhibited by the individual lamp harps in a batch of 100 lamp harps may vary from as much as about 3 to 8 degrees. The shade mounting assembly includes stop engaging elements that are positioned to engage the stop elements when the shade has been tilted to the maximum degree allowed. The elements that cooperate to limit the extent of this arcuate excursion are provided by the parts that are necessarily provided in the assembly to perform the traditional functions performed by a lamp harp. Separate additional elements are not added to the structure. Expense and complications in design, parts procurement, inventory and handing, and production are thus avoided. Typically, the lamp harp wire and the mounting stud are fashioned to provide the required arc limiting structure. The positioning of the stop elements relative to the stop engaging elements defines the length of the limited arc that the shade is permitted to traverse.

Other objects, advantages, and novel features of the present invention will become more fully apparent from the following detailed description of the invention when considered in conjunction with the accompanying drawings, or may be learned by the practice of the invention as set forth herein.

BRIEF DESCRIPTION OF THE DRAWINGS

The present invention provides its benefits across a broad spectrum of lamp harps. While the description which follows hereinafter is meant to be representative of a number of such applications, it is not exhaustive. As those skilled in the art will recognize, the basic apparatus taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustrating the invention and its presently understood best mode only and not limitation.

DETAILED DESCRIPTION OF THE PREFERRED EMBODIMENTS

Figure 1:
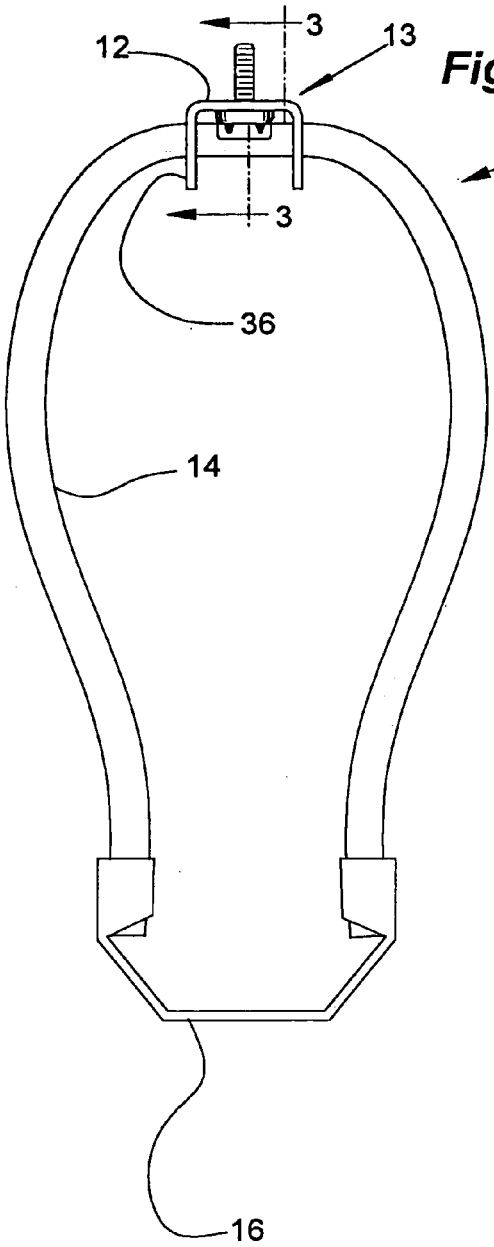
FIG. 1 is an elevational view of a preferred embodiment of the invention wherein a shade mounting assembly is mounted to the top of a harp frame member.
Figure 5:
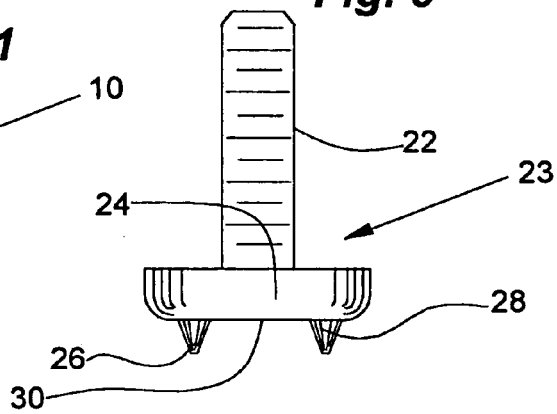
FIG. 5 is a side elevational view of a headed stud of the embodiment of FIG. 1.
Figure 6:
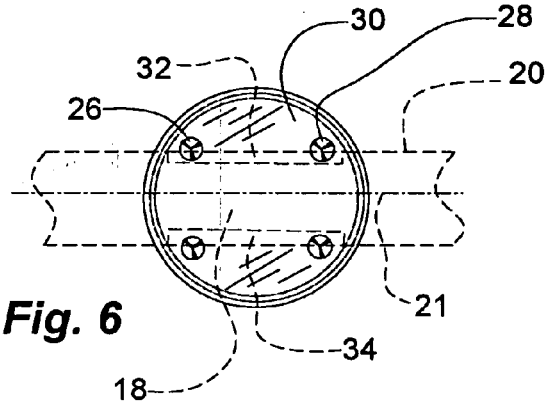
FIG. 6 is a bottom plan view of the headed stud of the embodiment of FIG. 1 showing the top part of the harp frame in phantom lines.
Figure 2:
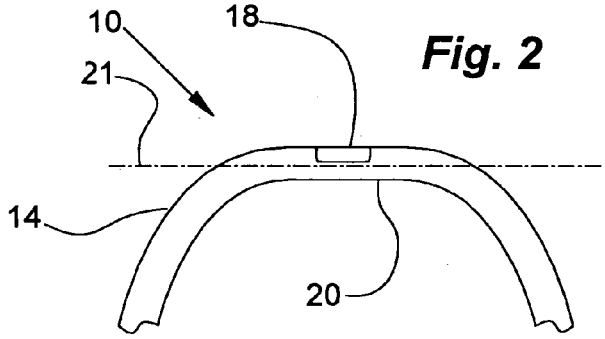
FIG. 2 is a broken elevational view of the harp frame of the embodiment of FIG. 1 without the shade mounting assembly.
Figure 3:
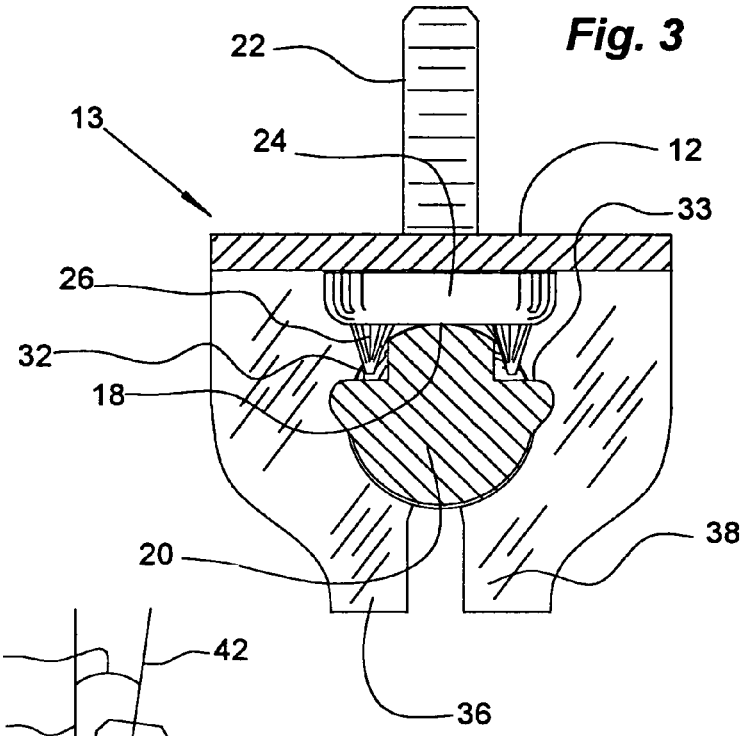
FIG. 3 is a cross-sectional view taken along line 3—3 in FIG. 1.

Referring now to the drawings wherein like reference numerals designate identical or corresponding parts throughout the several views. It is to be understood that the drawings are diagrammatic and schematic representations of various embodiments of the invention, and are not to be construed as limiting the invention in any way. The use of words and phrases herein with reference to specific embodiments is not intended to limit the meanings of such words and phrases to those specific embodiments. Words and phrases herein are intended to have their ordinary meanings, unless a specific definition is set forth at length herein.

Referring particularly to the drawings, there is illustrated generally at 10 a lamp harp comprised of a wire frame 14, which includes, for example, a generally straight axle portion 20 extending between opposed depending arm members. The axle portion 20 extends generally along longitudinal axis 21. The distal ends of the arm members are joined through socket mount 16.

A shade mounting assembly 13 is comprised of a yoke and a headed stud 23. The generally U-shaped yoke includes a base 12 and ears 36 and 38 depending from opposed edges of base 12. Ears 36 and 38 are perforated and rotatably journaled at such perforations on axle portion 20 of wire frame 14. Headed stud 23 is comprised of an enlarged head 24, and a threaded stud 22. Headed stud 23 is, for example, generally in the form of a headed machine screw with an externally threaded stud 22 projecting outwardly from approximately the center of the proximal side of the enlarged head 24. The thread on the threaded stud 22 matches the internal thread of a finial (not shown) for securing a lamp shade to shade mounting assembly 13.

The distal side 30 of head 24 is adapted to bear firmly against and in frictional engagement with the adjacent outer surface of axle portion 20. At least two stop engaging elements 26 and 28, respectively, project generally outwardly from the distal face 30 of enlarged head 24.

Axle portion 20 of harp frame 14 has a bearing surface 18 that is adapted to frictionally engage and bear slidably against the distal face 30 of headed stud 23 as shade mounting assembly 13 rotates approximately around longitudinal axis 21. The extent of this rotation is limited by the interengagement of stop and stop engaging elements. The extent of the limited arc is illustrated for two preferred embodiments in FIGS. 4 and 7. The longitudinal axis 42 of threaded stud 22 extends generally normal to longitudinal axis 21 of the axle portion 20. The arc 44 shows the extent of the permitted excursion of the shade mounting assembly in one direction of axis 42 from vertical 40. Line 40 shows where vertical is. The total permitted arc of travel is approximately twice the length of arc 44.

Headed stud 23 provides a threaded shank or stud 22 that project outwardly from approximately the center of the proximal face of enlarged head 24. The threaded shank 22 serves to threadably mount a finial (not shown) to hold a lamp shade hub (not shown) assembled to the lamp harp 10. The plan form of the head 24 is shown as being approximately round, but this shape is not critical. The head 24 serves to keep the threaded shank in the desired location, to provide stop engaging elements, and to provide a surface 30 to frictionally engage and slidably rotate against the adjacent surface 18 of axle portion 20.

Figure 7:
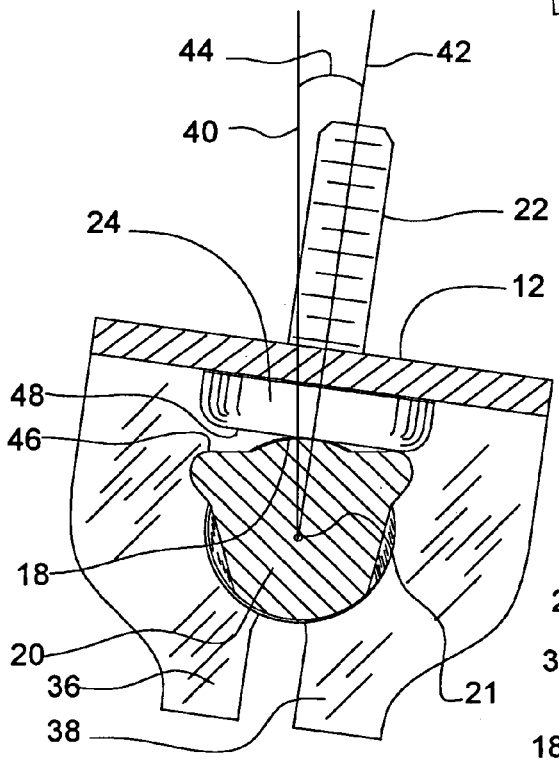
FIG. 7 is a cross-sectional view similar to FIG. 4 of a further embodiment of the invention.
Figure 4:
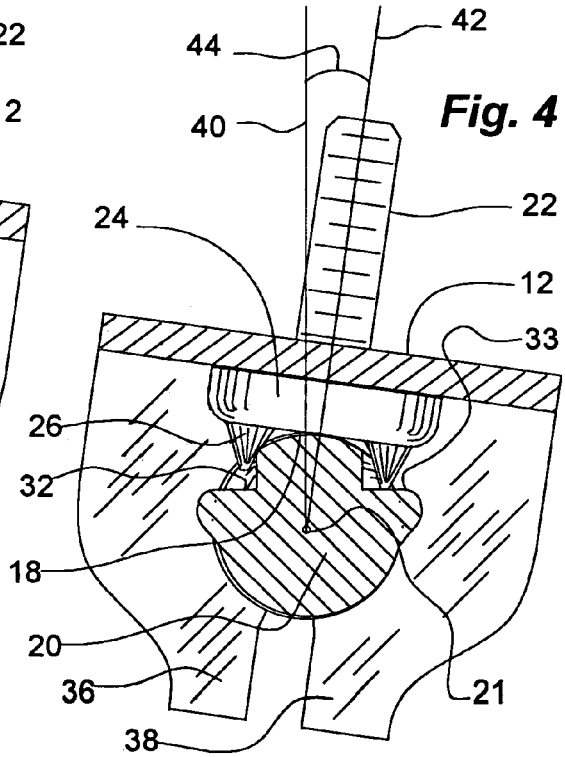
FIG. 4 is a cross-sectional view similar to FIG. 3 showing the shade mounting assembly rotated to the full limit of its permitted arc of travel in one direction with a stop engaging element stoppingly engaged with a stop element.

The stop engaging elements can take the form of projections that extend generally outwardly of the distal face 30, or regions, of which 48 is typical, (FIG. 7) or the distal face 30 itself can serve as the stop engaging elements. In the embodiment, for example, of FIG. 7, the stop elements 46 extend outwardly from the axle portion 20 and are engagably associated with the mating stop engaging elements 48 on distal face 30 of head 24. In the embodiment of, for example, FIG. 4, the stop elements are defined by indentations in axle portion 20. Some metal flows outside of the nominal circumference of the undistorted axle 20 during the deforming operation by which the stop elements are formed. Depending on the exact positioning of the engagingly associated elements, the projecting stop engaging elements can engage stop elements that are outside of the undistorted circumference of the axle portion 20. That is, both of the engagingly associated elements can be in the form of projections from their respective substrates. The characteristics of the engagingly associated elements should be such that they firmly engage one another at the respective ends of the limited arc of which arc 44 is approximately one-half (FIGS. 4 and 7). The lamp shade has a considerable amount of leverage (a lever arm typically of more than 6 inches) against these elements, so the interengagement must, for safeties sake, be solid enough to resist this considerable leverage. To this end, it is preferred, although not essential, that at least one element should be a solid surface that extends approximately normal (within approximately 15 degrees) to the direction in which the other element bears against it. In the embodiment of, for example, FIG. 4, the indentations in the axle 20 provide solid surfaces 32 and 33 that extend approximately normal to the direction of the force exerted by the associated stop engaging elements on the head 24. In any event, these elements should be configured so that the interengagement of these elements is solid enough to resist further rotation of the lamp shade.

As manufactured, the ears 36 and 38 of the U-shaped yoke are separated by a straight slot that opens downwardly. The shade mounting assembly 13 is mounted to axle portion 20 by inserting the slots over the axle portion 20 and crimping the ears 36 and 38 around the axle portion 20. The crimping is such that the distal face 30 of head 24 is forced into engagement with arcuate surface 18 of axle portion 20, and it is held there permanently. The axle portion is preferably generally straight so that the rotation of the shade mounting assembly does not change the distance between the longitudinal axis 21 and distal face 30.

The length of the permitted arc of rotation depends in part on the shape and arrangement of the lamp elements. The purpose of the present invention is to keep the shade far enough away from the light bulb to avid heating the shade to the temperature where it ignites. In some lamp configurations this dictates that the lamp shade be permitted no more than a total arc length of approximately 2 to 5 degrees. In other configurations, an arc length of up to approximately 30 to 45 degrees is possible before a fire hazard develops. Too large extent, the shape of the harp and the length and angle of the shade spokes dictates where the average sized bulb will be located relative to the shade. Typically, although not necessarily, the lamp shade hub and spokes (not shown) project generally in approximately the same plane as the shade mounting member. An elongated harp, as compared to the axial length of the associated bulb requires the use of an elongated shade, which changes the geometry of the system, including the length of the permitted arc of travel for the shade.

The desired fire safety is achieved according to the present invention without the use of any extra elements. The yoke, stud and generally straight axle portion are typically required to mount the shade to the harp. The arc limiting deformation of the axle portion and/or the stud head or yoke, or both is easily and inexpensively accomplished.

If desired, the headed stud can be, for example, swaged or stud welded into the base of the U-shaped yoke without the necessity for a head. The downwardly facing surface of the base of the yoke is then formed to provide the desired stop engaging elements. For example, if the head is eliminated in FIG. 7 and surface 18 is brought to bear directly against the adjacent surface of base 12, the necessary arc limiting stop mechanism is provided. Likewise, the projections of which 26 and 28 are typical could be formed in the normally downwardly facing side of base 12.

It will be appreciated that the objectives of the present invention can be accomplished by a variety of devices and structures other than those specifically illustrated herein. Accordingly, the present invention should not be construed as limited solely to the disclosed embodiments. The lamp harp of the present invention is generally constructed of metal because of the fire hazard or high costs associated with other materials. Other materials of construction can be used, if desired.

What have been described are preferred embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described.

What is claimed is:

1. A lamp harp comprising:

a frame member including an axle portion, said axle portion being generally straight and extending along a longitudinal axis, said axle portion including stop elements generally disposed on opposite sides of said longitudinal axis;

a shade mounting assembly rotatably mounted to said axle portion, said shade mounting assembly being rotatable through a limited arc of from approximately 2 to 45 degrees generally around said longitudinal axis, said shade mounting assembly including stop engaging elements engagably associated with said stop elements and adapted to define the length of said limited arc.

2. The lamp harp of claim 1 wherein said shade mounting assembly includes a headed stud having a threaded stud projecting from approximately the center proximal side of a head element, said stop engaging element projecting generally from an opposed side of said head element toward said stop element.

3. The lamp harp of claim 1 wherein said stop element comprises an indentation in said axle portion.

4. The lamp harp of claim 1 wherein said stop element comprises a protrusion integral with and projecting from said axle portion.

5. The lamp harp of claim 1 wherein said stop engaging element comprises a protrusion projecting from said shade mounting assembly, and said stop element comprises an indentation in said axle portion.

6. The lamp harp of claim 1 wherein said mounting assembly being rotatable through a limited arc of from approximately 2 to 30 degrees.

7. The lamp harp of claim 1 wherein said mounting assembly being rotatable through a limited arc of from approximately 2 to 10 degrees.

8. The lamp harp of claim 1 wherein said mounting assembly being rotatable through a limited arc of from approximately 2 to 6 degrees.

9. A lamp harp comprising:

a frame member including an axle portion, said axle portion being generally straight and extending along a longitudinal axis, said axle portion including a stop element formed therein, said stop element being generally disposed on opposite sides of said longitudinal axis;

a shade mounting assembly rotatably mounted to said axle portion, said shade mounting assembly being rotatable through a limited arc of from approximately 2 to 45 degrees generally around said longitudinal axis, said shade mounting assembly including a yoke member and a headed stud member, said yoke member being journaled on said axle portion, and a head element of said headed stud being positioned between said axle portion and said yoke member, a stop engaging element projecting from said head element into engageable association with said stop element, the length of said limited arc being defined by said engageable association.

10. A lamp harp comprising:

a frame member including an axle portion, said axle portion being generally straight and extending along a longitudinal axis and a shade mounting assembly rotatably mounted to said axle portion, said shade mounting assembly including a headed stud member, said headed stud member including a head element, said head element being mounted in frictional engagement with said axle portion;

a stop element integral with said axle portion; and a stop engaging element integral with said head element, said stop engaging element being in engageable association with said stop element, said shade mounting assembly being rotatable through a limited arc of from approximately 2 to 45 degrees generally around said longitudinal axis, the length of said limited arc being defined by said engageable association.

11. The lamp harp of claim 10 wherein said stop element comprises an indentation in said axle portion.

12. The lamp harp of claim 10 wherein said stop element comprises a projection from said axle portion.

13. The lamp harp of claim 10 wherein said stop engaging element comprises a projection from said head element.

* * * * *